United States Patent [19]

Torre

[11] Patent Number: 4,555,895

[45] Date of Patent: Dec. 3, 1985

[54] MACHINE FOR PACKAGING PRODUCTS IN HEAT-SHRINKABLE FILM

[76] Inventor: Francesco Torre, Via Baschenis 3, Dalmine (Bergamo), Italy

[21] Appl. No.: 557,932

[22] Filed: Dec. 5, 1983

[30] Foreign Application Priority Data

Dec. 13, 1982 [IT] Italy ..... 24719 A

[51] Int. Cl.[4] ..... B65B 53/06; B65B 11/48

[52] U.S. Cl. ..... 53/557; 53/229

[58] Field of Search ..... 53/228, 229, 442, 557

[56] References Cited

U.S. PATENT DOCUMENTS

| | | | |
|---|---|---|---|
| 3,777,446 | 12/1973 | Graver | 53/557 |
| 3,853,218 | 12/1974 | Grasvall | 53/442 |
| 3,933,569 | 1/1976 | Grasvoll | 53/557 |
| 3,994,114 | 11/1976 | Nishimura | 53/557 |
| 4,162,604 | 7/1979 | Bartolomei . | |

FOREIGN PATENT DOCUMENTS

| | | |
|---|---|---|
| 1761545 | 12/1970 | Fed. Rep. of Germany . |
| 1372671 | 11/1974 | United Kingdom . |

*Primary Examiner*—Robert L. Sprull

*Assistant Examiner*—Richard M. Mudd

*Attorney, Agent, or Firm*—Stevens, Davis, Miller & Mosher

[57] ABSTRACT

This invention relates to a machine (10) for packaging products in heat-shrinkable film, of the so-called bundling machine type, in which the film (65) fed from opposing reels (67) and (68) is made to pass over a product support platform (17) which is lowered into a vertically extending chamber (13) comprising at its top an aperture (16) which can be closed alternately by said support platform (17) and by a lateral panel (18) which is mobile horizontally when said platform (17) is in its lowered position.

Within said chamber (13) there are positioned film welding means (51) and (52) and means (19) and (20) for heating the film when wrapped and welded about the product (66) in order to cause its heat-shrinkage. Furthermore, in a position corresponding with said aperture (16) of the chamber (13), means (80) are provided for lifting the film into a position above said support platform (17) when this latter has been raised in order to close the chamber (13) and carries the finished package (102).

14 Claims, 15 Drawing Figures

MACHINE FOR PACKAGING PRODUCTS IN HEAT-SHRINKABLE FILM

This invention relates to a packaging machine of the type known as a bundling machine, in which one or more products are at least partially wrapped by a film of heat-shrinkable material.

In the machine according to the invention, the wrapping of the film about the product to be packaged and the heat-shrinkage of said film are characteristically effected within a single packaging chamber.

In this respect, bundling machines of known type are formed from a unit for wrapping and welding the film about the product to be packaged, and an oven into which the product is then immersed in order to cause said film to shrink on to this latter.

Machines of this type are very bulky and costly, and are justified only for very high production rates.

The main object of the present invention is to provide a bundling machine of extremely small dimensions in comparison with those of conventional machines, and thus of low cost and consequently justified even for relatively low production rates, and of low power consumption.

This object is attained according to the present invention by a machine for packaging products in heat-shrinkble film, of the so-called bundling machine type, comprising, in combination, a platform for supporting the product to be packaged, by way of said film which is continuously fed from a pair of opposing reels, welding means arranged to wrap two opposing edges of said film about the product and to weld them together, and a chamber for heating the film wrapped about the product, characterised in that said chamber extends vertically, and comprises at its top an aperture which can be closed alternately by said support platform, which can be lowered into said chamber, and by a lateral panel which is horizontally mobile on to said aperture when said platform is lowered, and in that said welding means form part of said chamber and are positioned above the support platform when this latter is lowered into said chamber.

Figure 1:
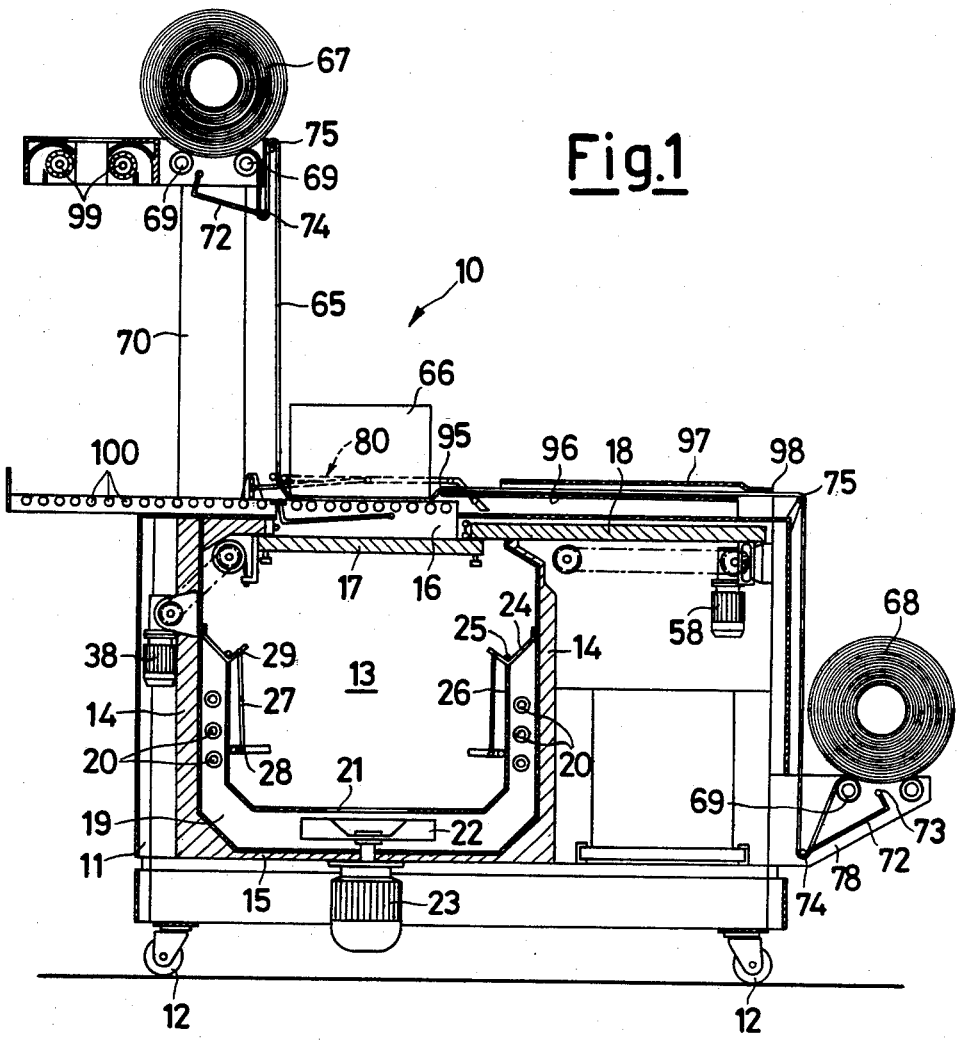
Figure 2:
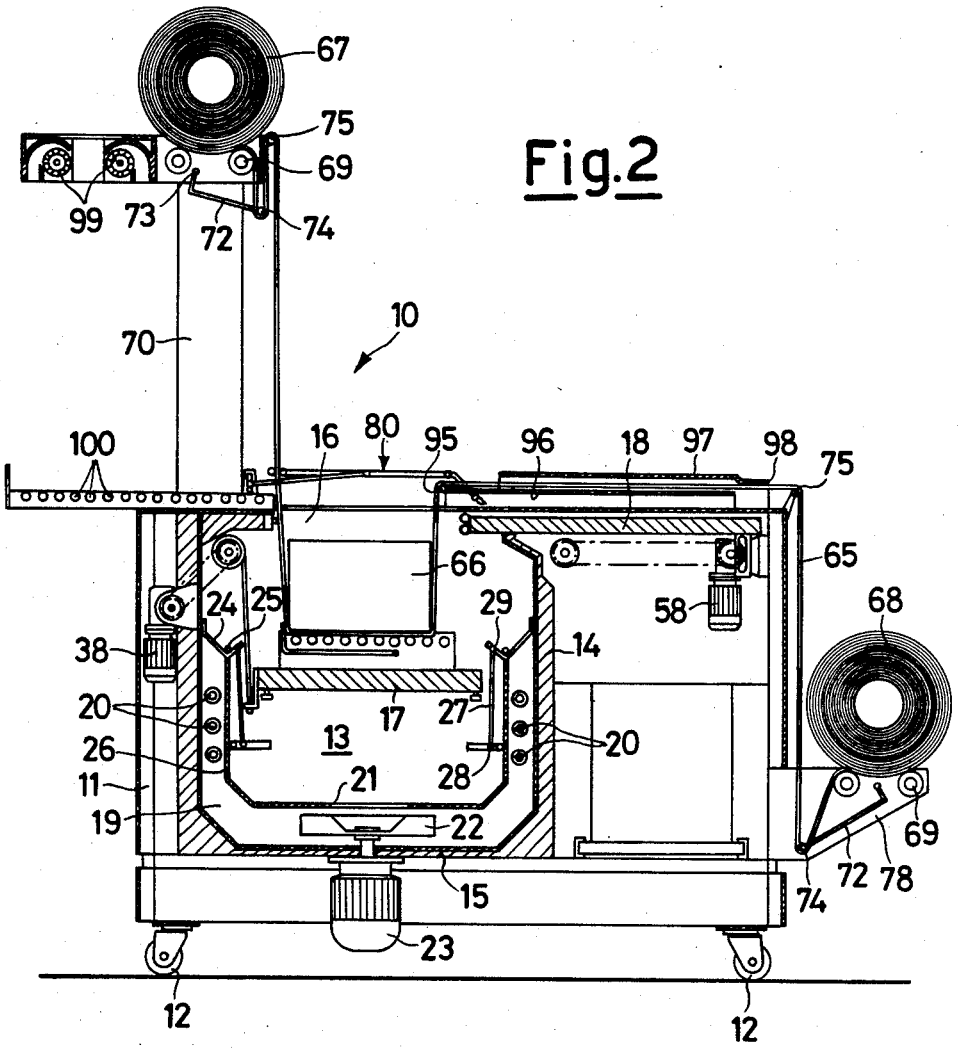
Figure 7:
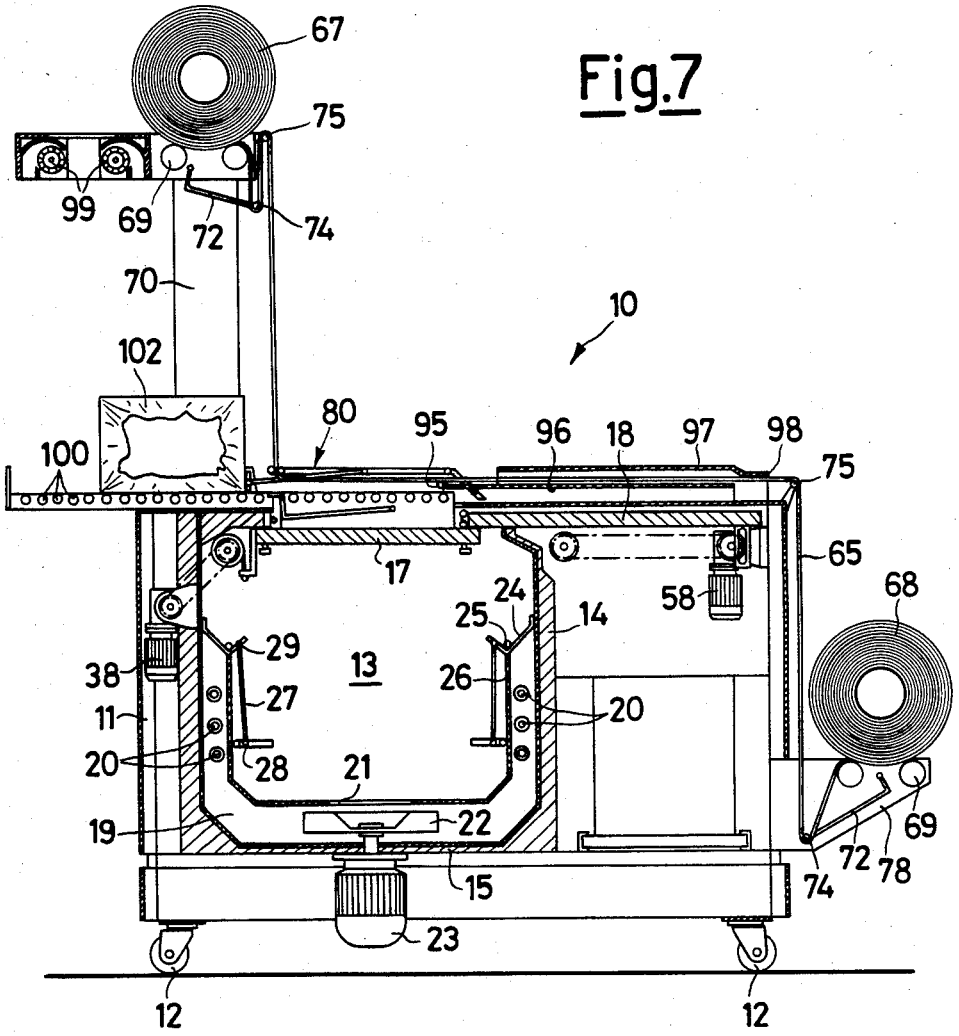
Figure 8:
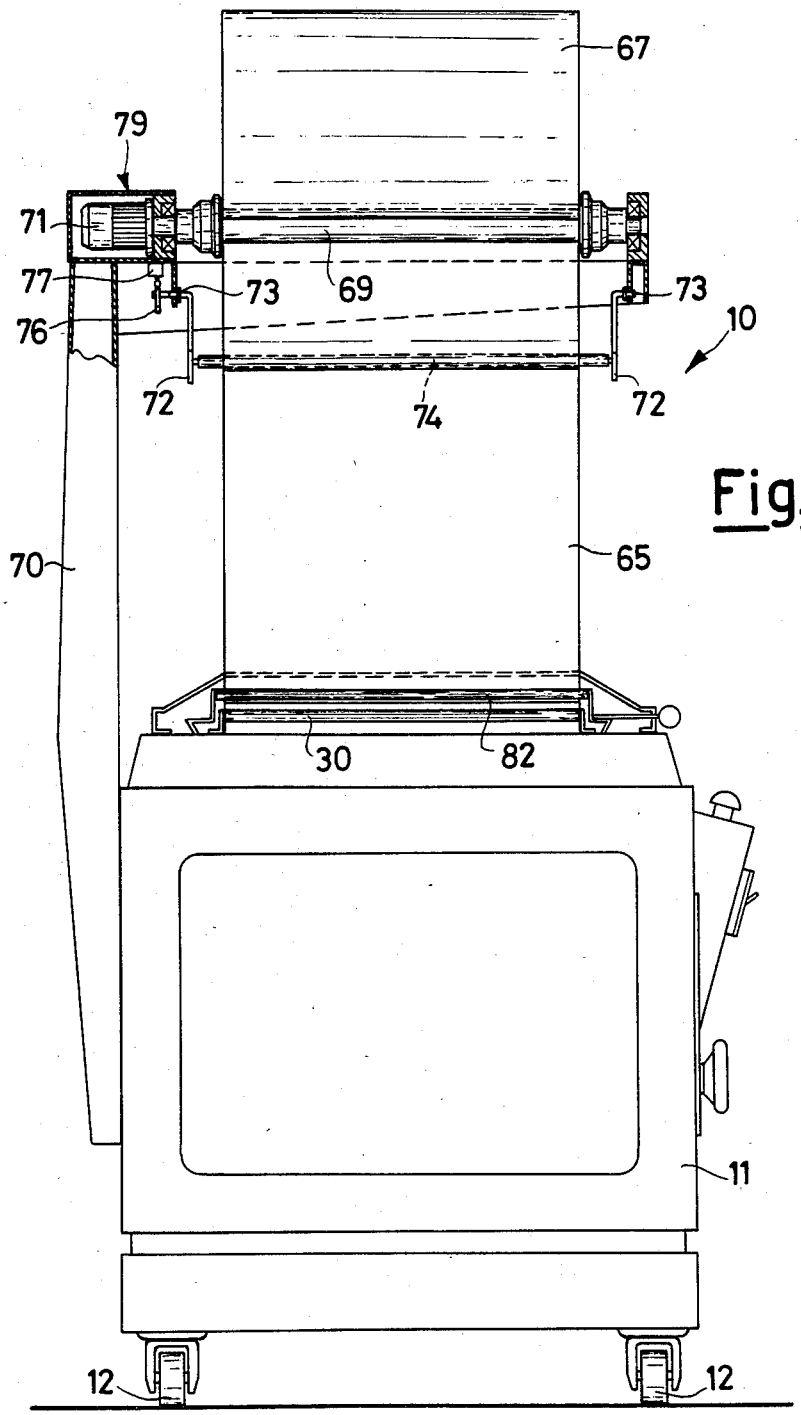
Figure 9:
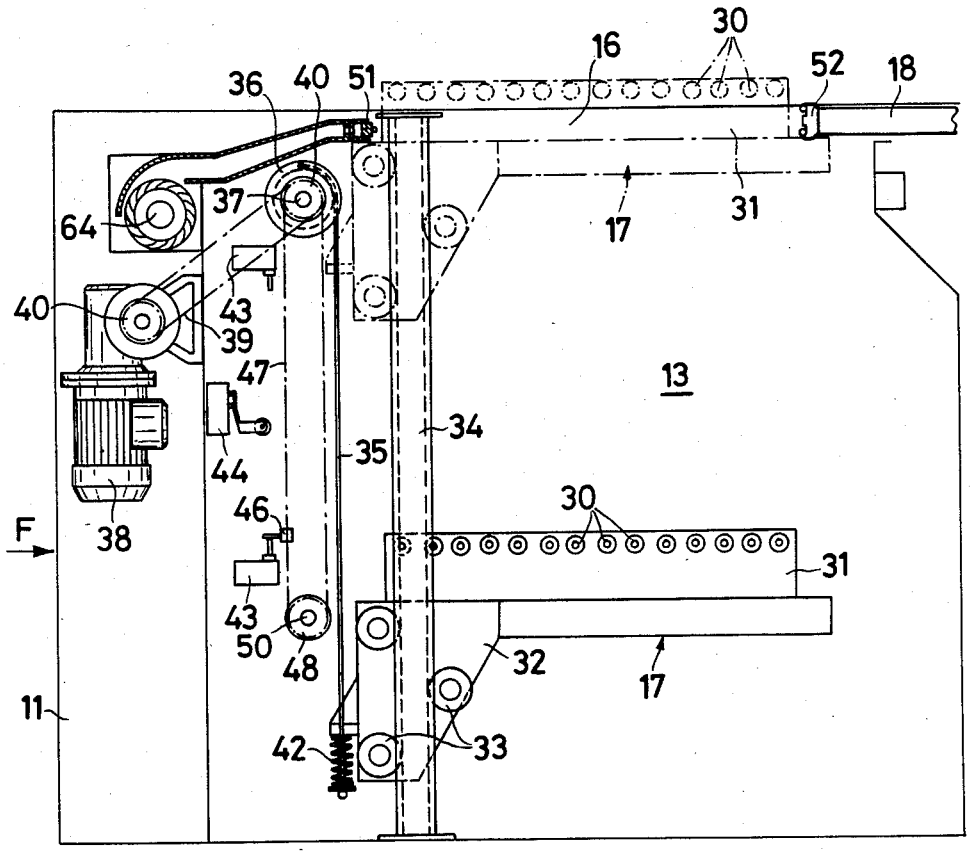
Figure 10:
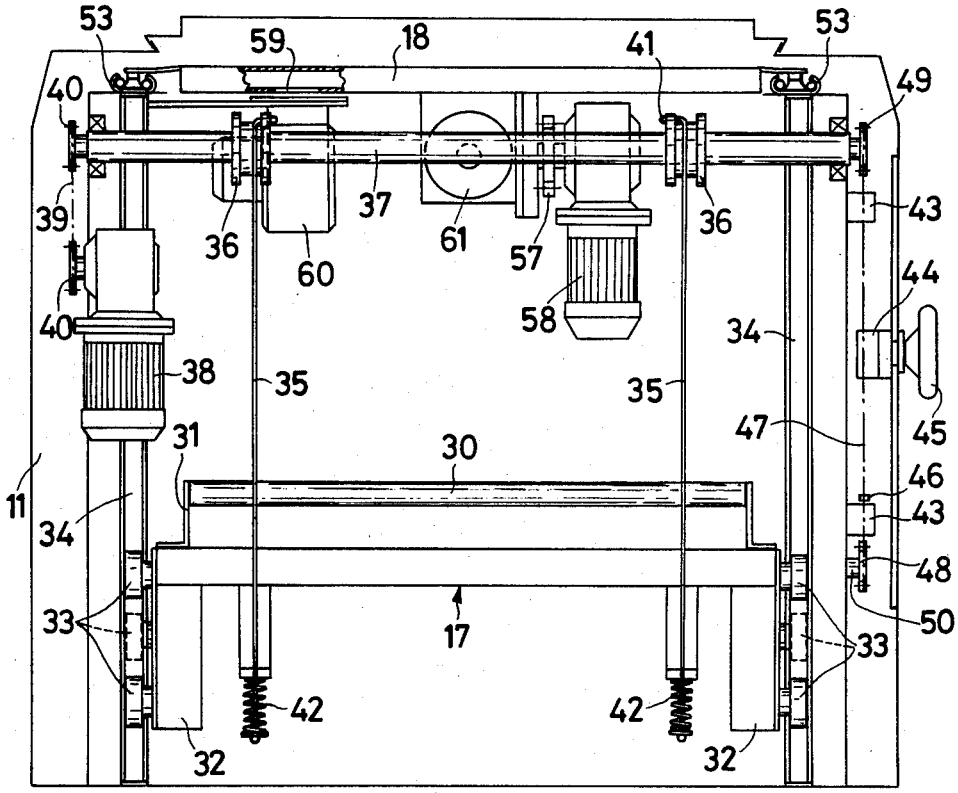
Figures 11, 13:
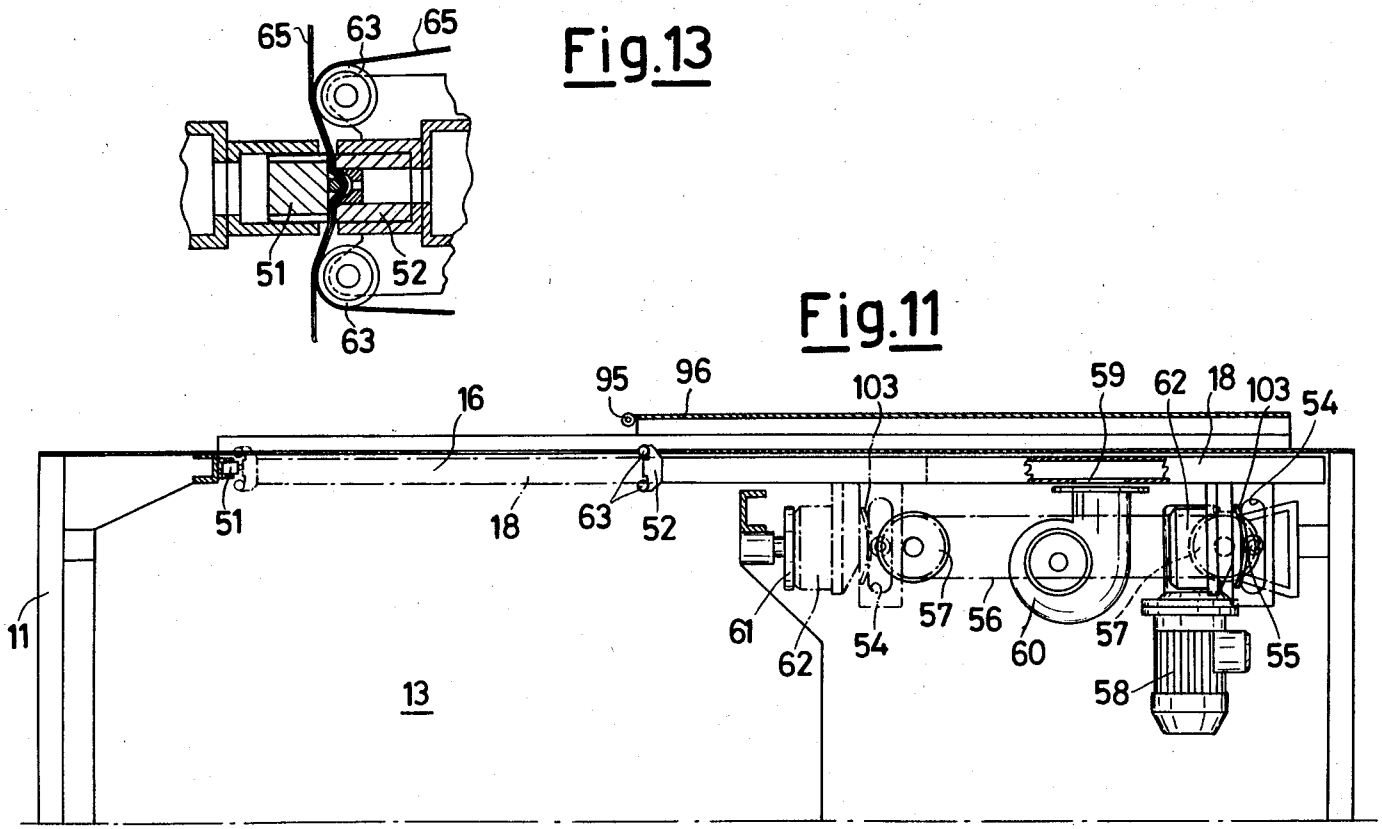
Figures 12, 14:
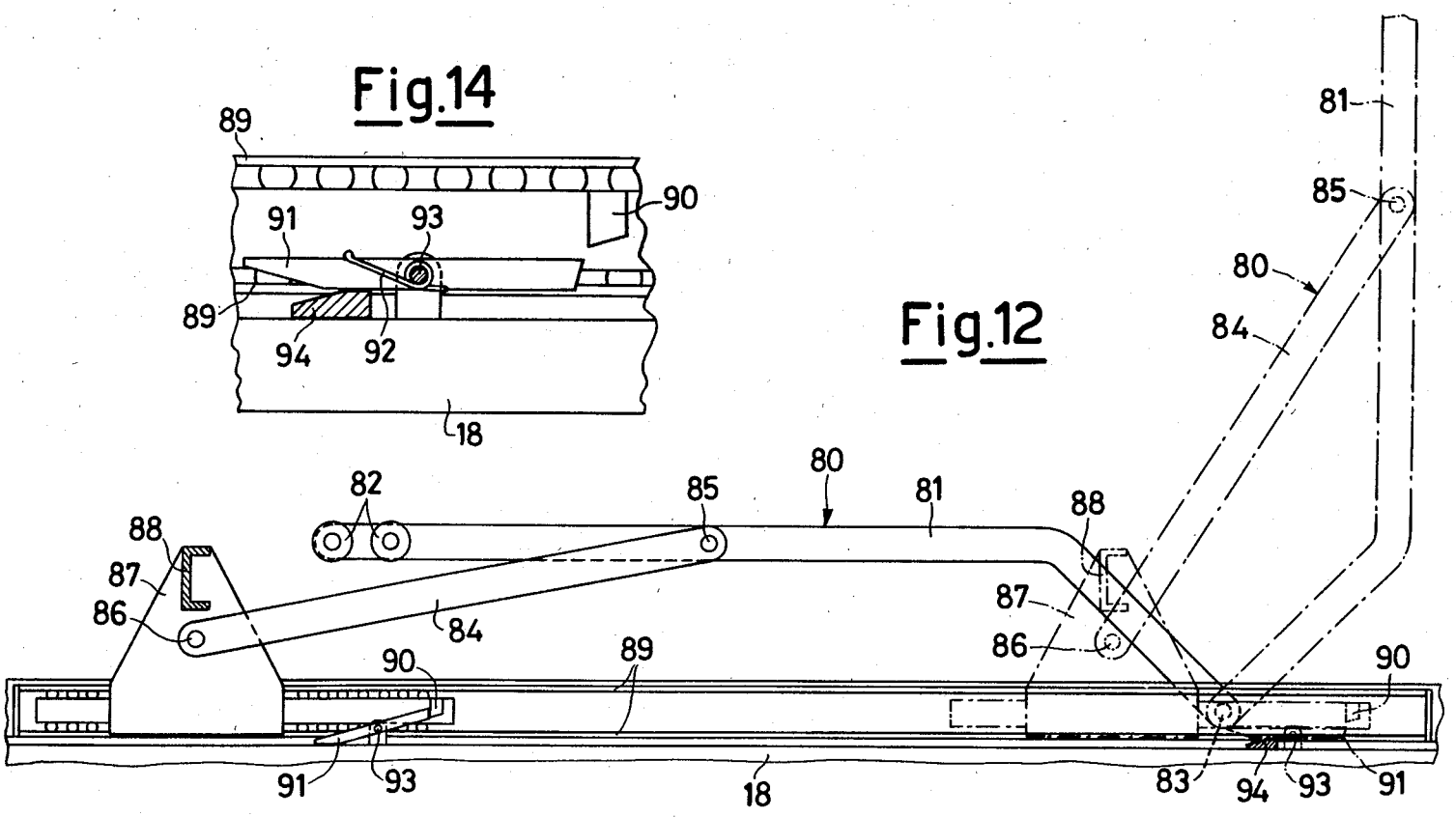

The operational and structural characteristics and advantages of a packaging machine according to the invention will be more apparent from the description given hereinafter with reference to the accompanying diagrammatic drawings, in which:

FIG. 1 is a partly sectional elevational view of a machine according to the invention, on which a product to be packaged is placed, FIGS. 2, 3, 4, 5, 6 and 7 are views identical to those of FIG. 1, but showing the machine in its various operating stages, FIG. 8 is an end elevational view of the machine, FIG. 9 is an enlarged elevational view of the machine platform and the relative drives, FIG. 10 is a view in accordance with the arrow F of FIG. 9, FIG. 11 is an enlarged elevational view of the closing panel and the relative drives, FIG. 12 is an enlarged elevational view of the film lifting framework located above the packaging chamber, FIG. 13 is an enlarged sectional detail of the welding and cutting unit, FIG. 14 is an enlarged sectional detail of the device for causing engagement between the panel and the film lifting framework.

Figure 15:
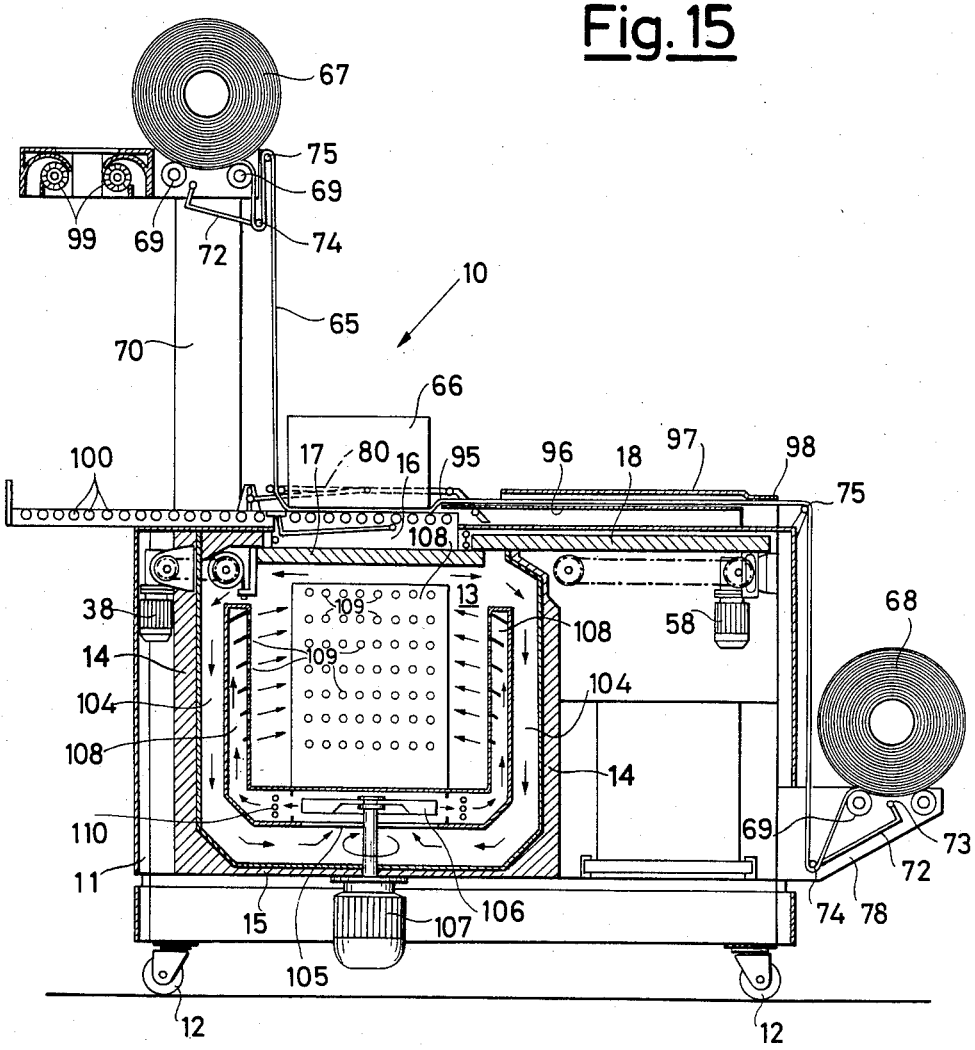

FIG. 15 is an elevational view of a machine according to the invention fitted with a different heating unit.

With reference to the drawings, a product packaging machine, of the so-called bundling machine type, indicated by the reference numeral 10, comprises a load-bearing structure 11, preferably mobile on wheels 12.

Said structure 11 carries a packaging chamber 13 with insulated side walls 14 and base 15, and which can be closed selectively at its top in a position corresponding with an aperture 16, either by a platform 17 or a panel 18 (FIG. 1).

Inside the chamber 13 there is provided a heating unit formed from a U-shaped duct 19 which extends along the base wall 15 and along two opposing side walls 14. On said side walls 14 there are mounted sets of electric heater elements 20 arranged to heat the air present in the chamber 13 and drawn through an aperture 21 provided in the horizontal portion of the U-shaped duct 19, by means of a fan 22 fitted with a motor 23.

A pair of flap valves 24, hinged at 25 to the walls 26 of the duct 19, closes the opposing ends of said duct 19. Said flap valves 24 are made to swivel about 25 by angle levers 27, which are supported and pivoted at 28 to the walls 26 and are connected by hinges 29 to said flap valves.

A vertically mobile platform 17 is formed from a roller table 30 carried by a ledge 31 extending from a carriage 32 provided with wheels 33 slidable on vertical guide rails 34 (FIG. 9). Said carriage 32 is controlled by cables 35 which wind about lifting drums 36 keyed on to a shaft 37, which by way of a chain drive 39 and gear wheels 40 is rotated by a geared motor 38 which is fixed to the load-bearing structure 11 (FIG. 10). The cables 35 are connected to the drums 36 at 41, and are provided, where they connect to the carriage 32, with elastic shock-absorber means 42.

The level of the platform 17 within the chamber 13 is determined by a pair of fixed end limit switches 43, and by a third intermediate limit switch 44 which can be adjusted in height by means of a handwheel 45, which positions it securely.

Said limit switches 43 and 44 are operated by a cam 46 connected to a chain 47 disposed vertically, and extending endlessly about two sprocket wheels 48 and 49. The support pin 50 for the sprocket wheel 48 is rigid with the load-bearing structure 11, while the other sprocket wheel 49 is keyed on to the lifting shaft 37 (FIG. 9).

A welding bar 51 is fixed on to one side of the top aperture 16 of the chamber 13, and cooperates with a backing element 52 mounted on the opposite side of the panel 18 (FIG. 11).

The panel 18 is mobile horizontally on guides 53, and its movement is determined by a link block 54 rigid therewith and perpendicular, a pin 55 being able to move slackly within said link block 54, which is provided with a leaf spring 103, and being connected to a chain 56 which extends endlessly about two sprocket wheels 57 and is disposed parallel to the guides 53 of the panel 18. Movement is transmitted to the chain 56 by a geared motor 58 which is fixed to the load-bearing structure 11 and operates one of the sprocket wheels 57 (FIGS. 10, 11).

The panel 18 is of box construction, and in its bottom it comprises an aperture 59 which, when in the rest position (FIG. 11), lies in a position corresponding with an electrically driven fan 60 for cooling its hollow interior, and consequently cooling the backing element 52.

A striker element 61 fixed to the machine frame cooperates with a time-controlled electromagnet 62 mounted on the panel 18 adjacent to the link block 54, and is shown by dashed and dotted lines in FIG. 11 in the position in which the panel 18 closes the aperture 16 of the chamber 13, when the platform 17 is lowered into this latter.

Adjacent to the backing element 52, the panel 18 carries a pair of idle guide rollers 63 disposed transversely to said panel 18.

The backing element 52, which can for example be of forked structure and constructed of teflon-coated rubber, is in this manner disposed between said rollers 63 (FIG. 13). As stated, said backing element 52 cooperates with a welding bar 51 fixed opposite the panel 18 at the aperture 16 of the chamber 13, said bar 51 being also provided with an electrically driven fan 64 for its internal cooling (FIG. 9).

A film 65 of heat-shrinkable material able to wrap one or more products 66 is fed to the packaging machine from a pair of opposing reels 67 and 68 (FIG. 1). The reel 67 is positioned on rollers 69 supported by an upright 70 which extends vertically upwards from the load-bearing structure 11. One of said rollers 69 is provided with a motor 71 which is operated by a unit which controls the loop formed by the film (FIG. 8).

Said unit for controlling the movement of the roller 69 comprises a pair of angle levers 72 which swivel about pins 73 positioned on the upright 70, and which at their free end support an idle roller 74 for guiding the film 65 towards an idle deviation roller 75 rigid with the upright 70. At its pivot point, one of said angle levers 72 carries a cam 76 which during the swivel movement of said lever operates a microswitch 77 for controlling the motor 71 of the roller 69 (FIG. 8).

In a similar manner to the reel 67, the reel 68 is positioned on a ledge 78 projecting from the load-bearing structure 11.

Said reel 68 is also provided with rollers 69, levers 72, a microswitch 77, motor 71, and rollers 74 and 75 to form an unwinding and compensating control unit 79 for the film 65, arranged to keep the film tension constant.

The components heretofore described constitute overall a film unwinding and compensating unit 79 of known type.

The film 65, extending between the reels 67 and 68, is positioned on the roller table 30 by a framework indicated overall by 80, which is fixed to the load-bearing structure 11 of the machine above the aperture 16 of the chamber 13. Said framework 80 is composed of a pair of parallel side bars 81 which carry the ends of two idle rollers 82 disposed transversely to the path of the film 65 (FIG. 12).

The bars 81 are made to swivel about pins 83 by connecting bars 84 which are pivoted at their two ends at 85 to the bars 81, and at 86 to a slide 87 carrying a pusher 88.

The pusher 88 is positioned on the slide 87, which is slidable horizontally on guides 89 and carries rigidly during its motion a tooth 90 for engagement with a rocking pawl 91 provided with a torsion spring 92 which is positioned on a central pin 93 (FIG. 14).

The pawl 91, rigid with the panel 18, is disengaged from the tooth 90 by a wedge 94, positioned on the guides 53, when the panel 18 has completely uncovered the access aperture 16 to the chamber 13.

The film 65, made to pass between the rollers 82, is guided by an idle roller 95 disposed at the end of a plate 96, so that it slides under a cover plate 97 which can be tilted about an end hinge 98.

It should be noted that the upright 70 supports fans 99 facing downwards to cool a roller table 100 (FIG. 7) for evacuating the finished packages 102, which are pushed thereon by the pusher 88 (FIG. 12).

The operation of a packaging machine according to the present invention is as follows:

when in its rest position, the packaging machine is ready to receive one or more products 66 to be packaged. Said products 66 are positioned on the roller table 30 of the platform 17 over which the film 65 from the reels 67 and 68 passes (FIG. 1).

The geared motor 38 is operated to cause rotation of the shaft 37 and the drums 36 which are rigid therewith, with the result that the cables 35 unwind.

The carriage 32 then descends as the wheels 33 slide on the guide rails 34, until the cam 46, which is fixed to the chain 47 driven by the sprocket wheel 49 rigid with the shaft 37, encounters the intermediate limit switch 44, thus blocking the carriage 32 (FIG. 1). Said limit switch 44 has been positioned by the hand wheel 45 in relation to the height of the product 66 to be packaged (FIG. 10).

Simultaneously, the unwinding units 79 feed the film 65 necessary for allowing this descent of the platform (FIG. 2), while maintaining it in a state of tension by virtue of the rocker levers 72 acting on the microswitches 77 controlling the motors 71.

At this point, the geared motor 58 drives the chain 56 rigidly carrying the pin 55, which drags the link block 54, the panel 18 consequently sliding along the guides 53.

During this movement, film 65 is supplied from the reel 68 under the action of the relative unwinding unit 79, and said film 65 slides over the two guide rollers 63 disposed at the end of the panel 18.

Figure 3:
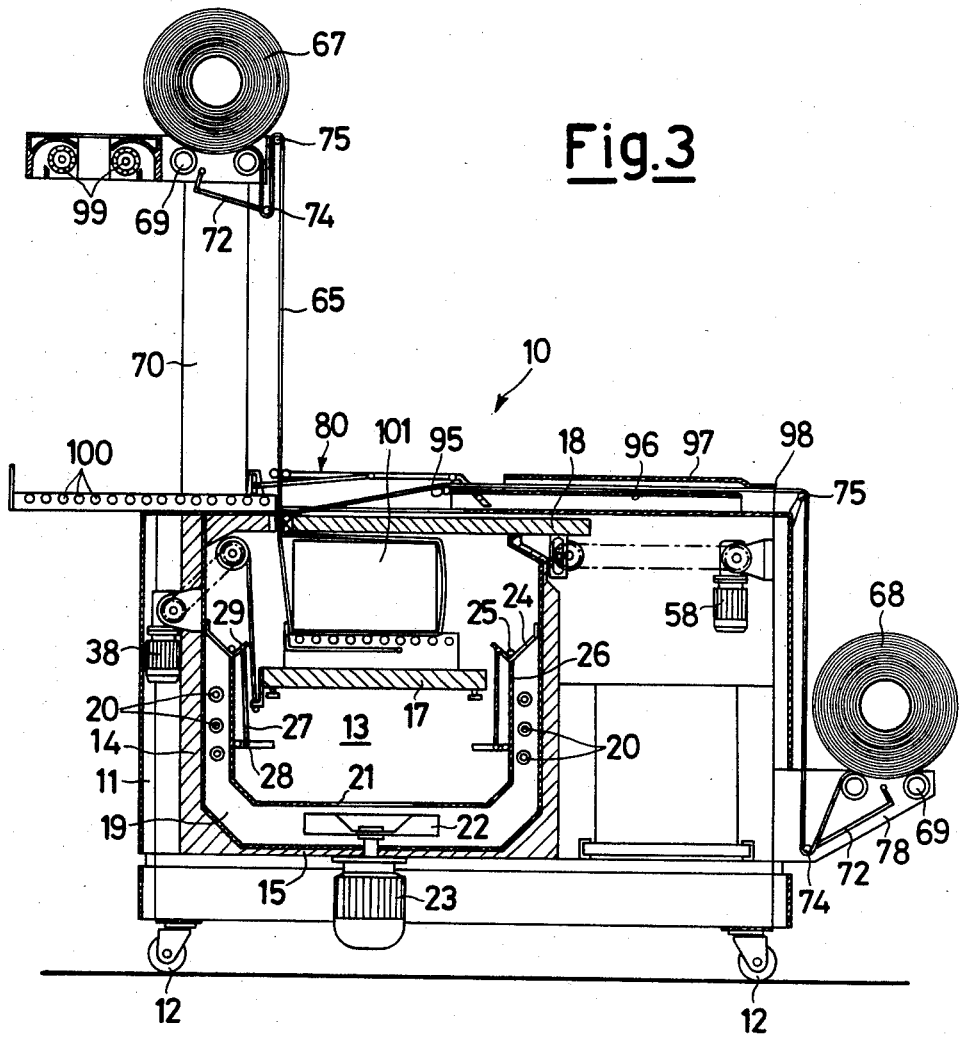

This movement proceeds until the panel 18 has completely closed the aperture 16 of the chamber 13, to bring the two edges of the film 65 into a position one above the other between the welding bar 51 and the welding backing element 52 (FIG. 3). In this position (FIG. 11), the striker element 61 enters the range of attraction of the electromagnet 62, so that the facing surfaces of these latter come into contact against the action of the spring 103, so enabling the film to be welded.

On de-energising the electromagnet 62, the leaf spring 103 causes the faces of the striker element 61 and electromagnet to separate from each other, thus causing the welding bar 51 to become detached from the backing element 52.

At the same time as the welding operation, which is double because of the presence of the forked backing element 52, the film is cut in an intermediate position by a known method, enabling the film to be closed around the product to form the so-called bundle 101, and at the same time preserving the continuity of the film between the two reels 67 and 68.

The further operation of the geared motor 38 leads to a second descent of the carriage 32 and of the bundle 101 positioned on the roller table 30, until the cam 46 operates the maximum descent limit switch 43, so stopping the geared motor 38 (FIG. 9).

Figure 4:
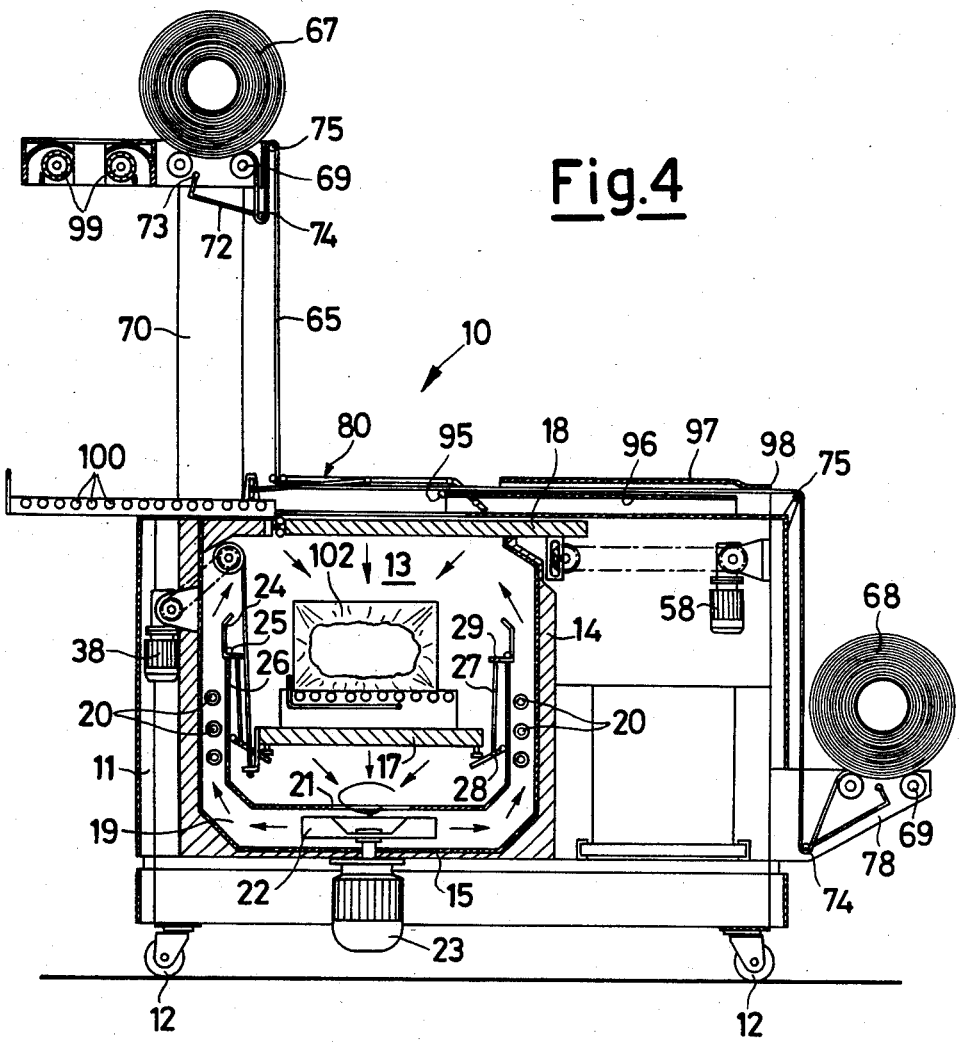

During the final part of said second descent, the platform 17 acts on the angle levers 27, which being hinged at 28 cause the flap valves 24 of the duct 19 to open (FIG. 4), and the hot air to emerge. In this respect, the air in the chamber 13 is drawn into said duct 19 by the fan 22, heated by the electric heater elements 20, and expelled from the open ends of said duct (as indicated by the arrows of FIG. 4), to strike the film 65 of the bundle 101, so causing it to shrink and form the finished package 102.

Alternatively, the heating unit within the chamber 13 can consist of two lateral and opposed air-aspiration ducts 104 which aspirate towards an opening 105 in the horizontal section of said ducts 104 by means of a fan 106 driven by a motor 107. The air is thus sent to the interior of four chambers or closed vertical channels 108 which on the walls towards the interior of the chamber 13, have a plurality of bores 109 for delivering the air, which is heated by being passed across a series of resistances 110 disposed in the four channels 108.

Said heated air leaving the bores 109 causes the film 65 of the bundle 101 to shrink, thus in an equivalent manner forming the finished package.

Figure 5:
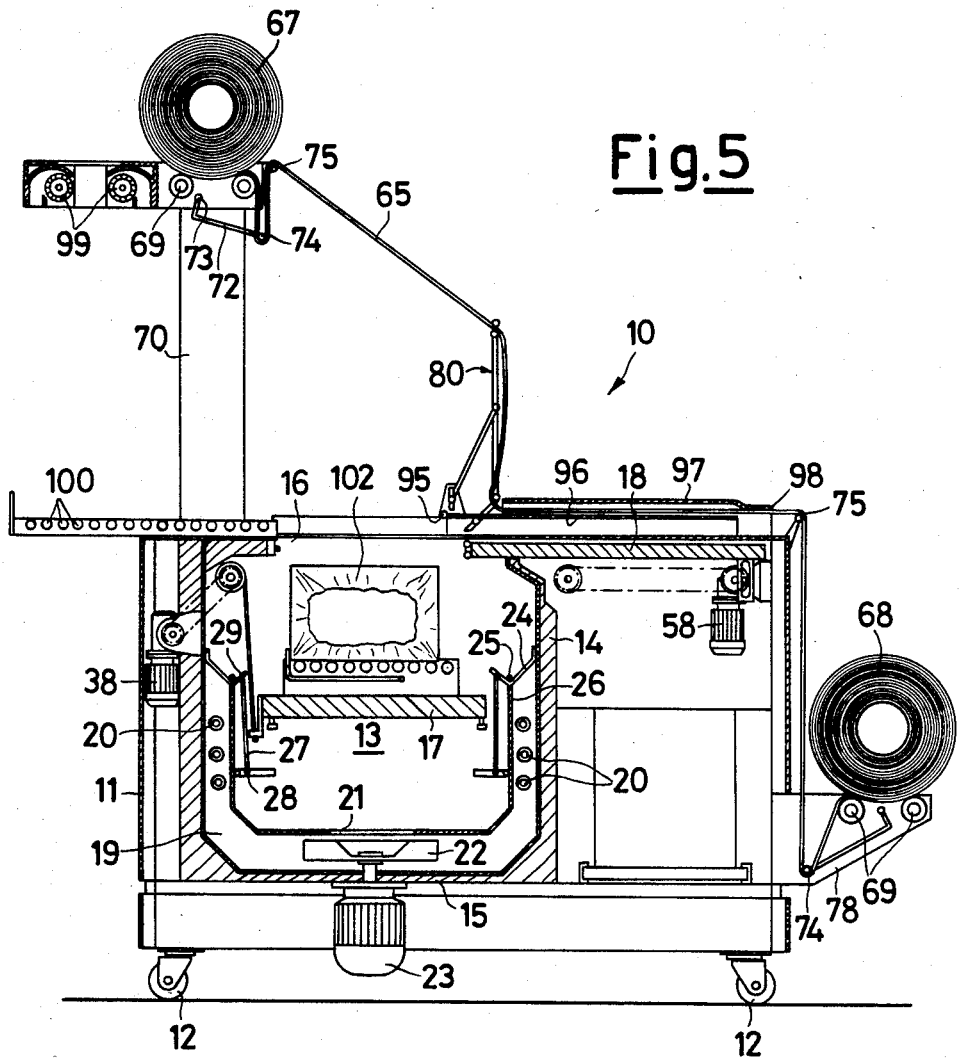
Figure 6:
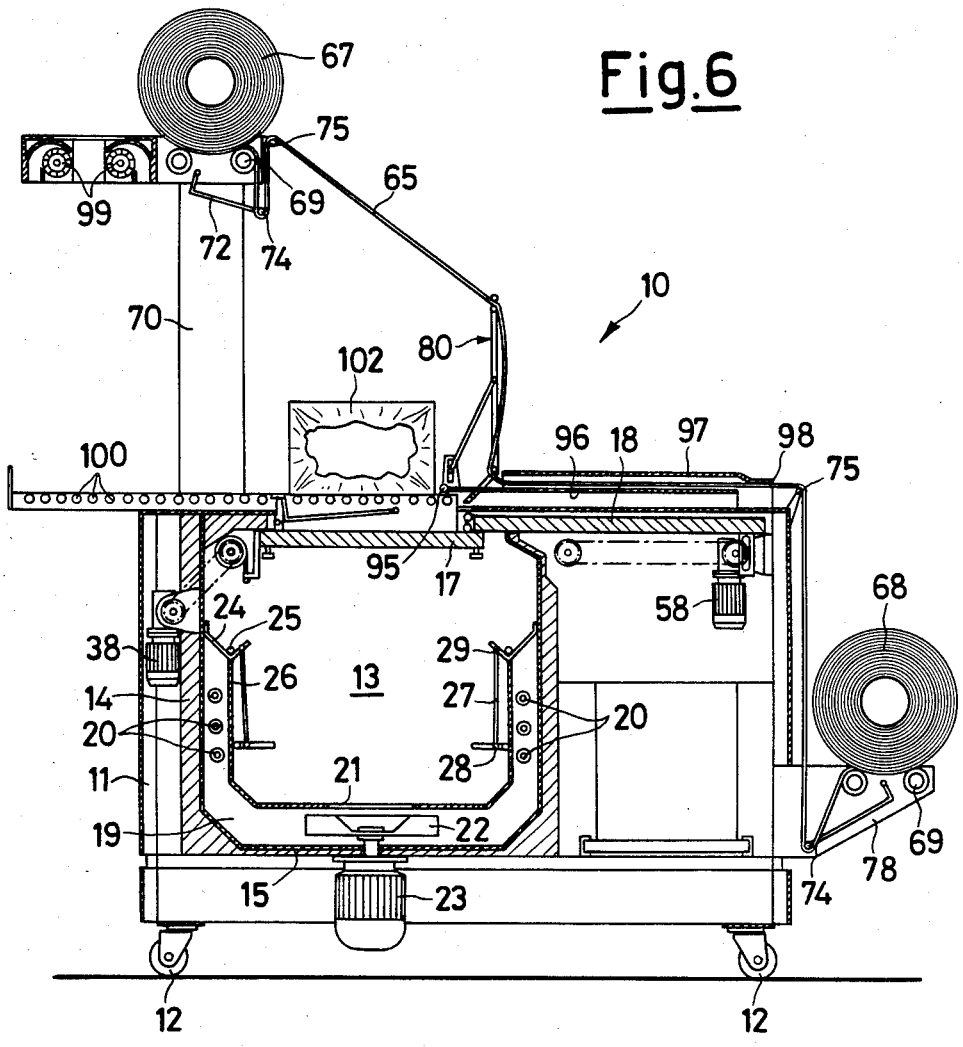

At this point, the geared motor 38 causes the platform 17 to undergo its rising stage and thus close the flap valves 24 of the ducts 19 (FIG. 5). Simultaneously, the panel 18 with the link block 54 rigid therewith is dragged by the pin 55 rigid with the chain 56, which is driven by the geared motor 58. This movement also causes movement of the slide 87, of which the tooth 90 had been previously made to snap-engage with the pawl 91 by the panel 18 as it completed the closure of the apertures 16, said pawl being under the action of the torsion spring and rigid with the panel 18.

The slide 87 pushes the connecting bars 84 which are pivoted thereto at 86, and said connecting bars 84 rotate the rods 81 about the pins 83, facilitated by the pivots 85 (FIG. 5). During this rotation, the film 65 passing between the rollers 82 is lifted from its initial path, so freeing the aperture 16 of the chamber 13.

Said movement enables the platform 17 to move to its maximum height, so closing the aperture 16 of the chamber 13, where it is halted by the upper limit switch 43 operated by the cam 46 carried by the chain 47 (FIG. 10). The panel 18, by reaching the position in which it has completely withdrawn into the structure 11 so as to completely free the aperture 16 of the chamber 13, has moved the pawl 91 into a position corresponding with the wedge 94, which compels it to remain in a horizontal position, so releasing the tooth 90 of the slide 87 (FIG. 14). The operator can now lower the bars 81 in order to reposition the film 65 on the roller table 30 of the platform 17 (FIG. 7).

This movement also causes the slide 87 to slide on the guides 89, with consequent contact of the pusher 88 against the package 102, and the sliding of the package 102 along the roller table 30 and then on to the roller table 100 (FIG. 7) for evacuating the finished packages from the machine.

The packaging machine 10 is thus ready for a new cycle for again packaging the product in the heat-shrinkable film.

The advantage of a machine constructed in accordance with the principles of the invention are apparent from the aforegoing description with reference to the accompanying drawings. Principally, effecting the complete operating cycle in a single vertically extending packaging chamber makes it possible to manufacture a very compact machine of low cost and thus suitable for solving the packaging problems of firms having a production rate which would not justify a production-line plant of conventional type.

In this respect it should be noted that the use of a single vertical chamber is possible in practice because the film welding operation is carried out in such a manner that the film is not influenced by the heat present in the chamber, even though this heat can be sufficient to facilitate and accelerate the subsequent heat-shrinking stage. This is attained by the welding operation taking place in an upper region of the chamber at relatively low temperature, this region not being directly influenced by the temporarily inactive heating unit. On the other hand, by making the platform carrying the product to be packaged move sequentially with the panel which carries out the film welding, adequate insulation of the chamber from the external environment is ensured, so that the machine operates at very satisfactory efficiency, and with low power consumption.

In addition, the moving panel acts simultaneously as a welding unit and as a separation member between the bundle formed inside the chamber and the film which is ready for forming a further package.

The use of a vertical packaging chamber provided with a single top aperture which serves both for receiving the product to be packaged and for extracting the packaged product is made possible by the provision of means (framework 80) which, automatically as the platform carrying the package rises, temporarily free the working zone from the presence of the film which is lifted to a level which gives no disturbance.

I claim:

1. A machine for packaging products in a heat-shrinkable film comprising a structure, means on said structure to mount rolls of film to wrap said product, a chamber mounted on said structure and means for shrinking the film about a wrapped product positioned in said chamber, said chamber having a base, sidewalls and an aperture at its top, a platform for said product mounted on said structure which is lowerable into said chamber and which covers said aperture when fully raised, means on said structure to lower and raise said platform, a lateral panel horizontally movable mounted on said structure which covers said aperture when said platform is in a lowered position and welding means mounted on said structure to weld two opposing edges of said film together when said platform and product are positioned within said chamber.

2. The machine of claim 1 including means mounted on said structure to lift the film to a position above the platform and package when said platform is being moved to a fully raised position.

3. The machine of claim 1 wherein said welding means comprise two elements one of which is positioned on an edge of said lateral panel and the other of which is positioned at an edge of said aperture to receive said element on said panel when the panel acts as a closure for said chamber.

4. The machine of claim 1 wherein the means for shrinking includes a heating means positioned within said chamber.

5. The machine of claim 4 wherein said heating means comprise heating elements mounted at the sides of said chamber, air circulation means mounted at the base of said container, U-shaped ducting to channel air from said circulation means over said heating elements and flap values on said ducting to release heated air to a film wrapped product.

6. The machine of claim 5 wherein said heater elements are lateral electrical heater elements and said circulation means is a fan, said ducting having an aperture therein through which air is drawn to pass over said heater elements.

7. The machine of claim 2 wherein said means to lift the film comprise a frame composed of a pair of swivel mounted bars disposed to a side of said aperture, idle rollers mounted on one of said bars, the film being disposed between said rollers, connecting bars pivotally connected to said swivel mounted bars, a slide hinged to said connecting bars, said slide being operationally dragged by said lateral panel as said panel uncovers said chamber aperture, and a pusher mounted on said slide for evacuating the finished package.

8. The machine of claim 1 wherein said platform is composed of a ledge and a roller table mounted on said ledge and said means to lower and raise said platform comprises a carriage with wheels, vertical guide rails upon which the wheels are mounted and means to move said carriage vertically.

9. The machine of claim 8 wherein said means to move said carriage vertically comprise drive cables connected to said carriage, a shaft mounted on said structure, drums keyed on said shaft about which said cables coil, a toothed gear keyed on said shaft, a geared motor mounted on said structure and a chain transmission interconnecting said motor and toothed gear.

10. The machine of claim 1 including a fan mounted on said structure and wherein said lateral panel is hollow and defines an aperture therein which aligns with said fan when said panel is positioned to uncover said aperture of said chamber.

11. The machine of claim 1 including guides mounted on said structure, said lateral panel movable on said guides, a link block rigidly connected to said panel, an endless chain, a pin oscillating within said link block and connected to said chain and a geared motor mounted on said structure to drive said chain.

12. The machine of claim 3 including an electromagnet mounted on said lateral panel, a striker element fixed to said structure, said electromagnet and striker element cooperating when said lateral panel acts as a closure for said aperture of said chamber and elastic means positioned between said electromagnet and said striker element.

13. The machine of claim 4 wherein said heating means comprise at least one pair of opposed ducts formed on the base and side walls of the chamber, a series of closed channels defining bores therein interconnected to said opposed ducts and electrical resistances positioned within said closed channels, said bores of said channels being directed toward the center of the chamber.

14. The machine of claim 13 including a fan disposed at the interconnection of said opposed ducts and said closed channels to aspirate air from said opposed ducts to said closed channels.

* * * * *